US009222161B2

(12) United States Patent
Inoue et al.

(10) Patent No.: US 9,222,161 B2
(45) Date of Patent: Dec. 29, 2015

(54) MAGNESIUM ALLOY SHEET AND METHOD FOR PRODUCING SAME

(75) Inventors: Ryuichi Inoue, Itami (JP); Kohji Inokuchi, Itami (JP); Yukihiro Oishi, Osaka (JP); Nozomu Kawabe, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 125 days.

(21) Appl. No.: 13/882,785

(22) PCT Filed: Nov. 8, 2011

(86) PCT No.: PCT/JP2011/075757
§ 371 (c)(1), (2), (4) Date: May 1, 2013

(87) PCT Pub. No.: WO2012/066986
PCT Pub. Date: May 24, 2012

(65) Prior Publication Data

US 2013/0220496 A1 Aug. 29, 2013

(30) Foreign Application Priority Data

Nov. 16, 2010 (JP) ..... 2010-255564
Nov. 16, 2010 (JP) ..... 2010-255565

(51) Int. Cl.
*C22C 23/02* (2006.01)
*C22F 1/06* (2006.01)
(Continued)

(52) U.S. Cl.
CPC ..... *C22F 1/06* (2013.01); *B22D 11/001* (2013.01); *C22C 23/02* (2013.01); *C22C 23/04* (2013.01); *C22C 23/06* (2013.01)

(58) Field of Classification Search
CPC ..... C22C 23/00; C22C 23/02; C22C 23/04; C22C 23/06
USPC ..... 420/402, 407; 148/406, 420, 557, 666
See application file for complete search history.

(56) References Cited

U.S. PATENT DOCUMENTS

2008/0279715 A1* 11/2008 Mori et al. ..... 420/408
2008/0311423 A1* 12/2008 Numano et al. ..... 428/687
2011/0318603 A1* 12/2011 Okuda et al. ..... 428/621

FOREIGN PATENT DOCUMENTS

CA 2741210 A1 * 4/2010 ..... C22C 23/02
JP 05-078775 A 3/1993
(Continued)

OTHER PUBLICATIONS

Dahle, Arne K., et al. "Development of the as-cast microstructure in magnesium—aluminium alloys." Journal of light metals 1.1 (2001): 61-72.*
(Continued)

*Primary Examiner* — Roy King
*Assistant Examiner* — Jophy S Koshy
(74) *Attorney, Agent, or Firm* — Ditthavong & Steiner, P.C.

(57) ABSTRACT

The magnesium alloy sheet disclosed herein has dispersed therein particles of an intermetallic compound containing an additive element (e.g., Al) and Mg (a typical example of which is $Mg_{17}Al_{12}$), and the ratio obtained by dividing the diffraction intensity of the main diffraction plane (4,1,1) of the intermetallic compound by the diffraction intensity of the c plane (0,0,2) of the Mg alloy phase in an XRD analysis of the surface of the sheet is 0.040 or more. The method includes: a casting step of producing a cast material composed of a magnesium alloy containing an additive element by continuous casting; a heat treatment step of holding the cast material at 400° C. or higher and then cooling the cast material at a cooling rate of 30° C/min or less to produce a heat-treated material; and a rolling step of subjecting the heat-treated material to warm rolling to produce a rolled sheet.

13 Claims, 2 Drawing Sheets

20 μm

(51) Int. Cl.

| | |
|---|---|
| ***B22D 11/00*** | (2006.01) |
| *C22C 23/04* | (2006.01) |
| *C22C 23/06* | (2006.01) |

(56) References Cited

FOREIGN PATENT DOCUMENTS

| | | | | |
|---|---|---|---|---|
| JP | 06-325508 | A | | 11/1994 |
| JP | 2005002378 | A | * | 1/2005 |
| JP | 2006152401 | A | * | 6/2006 |
| JP | 2007-098470 | A | | 4/2007 |
| WO | 2010047045 | A1 | | 4/2010 |
| WO | 2010103971 | A1 | | 9/2010 |
| WO | WO 2010103971 | A1 | * | 9/2010 ..... C22C 23/02 |

OTHER PUBLICATIONS

International Search Report for PCT/JP2011/075757, mailed Feb. 14, 2012.

Notification of Reasons for Rejection for corresponding Japanese Patent Application No. 2010-255564 dated Feb. 24, 2014, 6 pages with partial English Translation included.

* cited by examiner

MAGNESIUM ALLOY SHEET AND METHOD FOR PRODUCING SAME

TECHNICAL FIELD

The present invention relates to a magnesium alloy sheet suitable as a material for various structural members, such as housings of electric/electronic devices, and a method for producing the same. More particularly, the invention relates to a magnesium alloy sheet having excellent corrosion resistance and a method for producing the same.

BACKGROUND ART

Magnesium alloys in which various additive elements are incorporated into magnesium have been used as materials constituting various structural members, such as housings of mobile electric/electronic devices, e.g., cellular phones and laptop computers, and parts of automobiles.

Structural members composed of a magnesium alloy are mainly produced using a cast material (an AZ91 alloy specified in the standards of the American Society for Testing and Materials (ASTM)) formed by a die casting process or thixomolding process. In recent years, structural members produced by subjecting sheets composed of a wrought magnesium alloy, typified by an AZ31 alloy specified in the standards of ASTM, to press forming have started to be used. For example, Patent Literature 1 proposes a magnesium alloy sheet composed of an alloy corresponding to the AZ91 alloy specified in the standards of ASTM and having excellent press formability.

Since magnesium is an active metal, the surfaces of the structural members and the magnesium alloys constituting the structural members are generally subjected to anticorrosion treatment, such as anodic oxidation treatment or chemical conversion treatment.

CITATION LIST

Patent Literature

PTL 1: Japanese Unexamined Patent Application Publication No. 2007-098470

SUMMARY OF INVENTION

Technical Problem

In the magnesium alloys containing Al, such as the AZ31 alloy and the AZ91 alloy, as the Al content increases, corrosion resistance tends to become higher. For example, the AZ91 alloy is considered to excel in corrosion resistance among magnesium alloys. However, even in the AZ91 alloy, the problem of corrosion resistance has not been sufficiently resolved, and the anticorrosion treatment is needed. In the case where anticorrosion treatment is not performed, even in the AZ91 alloy, corrosion proceeds when the alloy is subjected to a corrosion test, such as a salt spray test or salt water immersion test. Furthermore, even in the case where coating is performed in addition to the anticorrosion treatment in order to improve corrosion resistance or the like, if scratches occur in the coating due to impact or the like or if the coating peels off due to degradation over time or the like, corrosion will proceed from portions where the alloy becomes exposed. Therefore, it is desired that the magnesium alloy sheet constituting a magnesium alloy structural member be excellent in corrosion resistance.

The present invention has been achieved under these circumstances, and it is an object of the present invention to provide a magnesium alloy sheet having excellent corrosion resistance and a method for producing the same.

Solution to Problem

The present inventors have performed thorough studies and have found that a magnesium alloy sheet having a specific structure exhibits excellent corrosion resistance, thus completing the present invention.

A magnesium alloy sheet of the present invention is composed of a magnesium alloy containing an additive element. The sheet has dispersed therein particles of an intermetallic compound containing the additive element and Mg. The sheet is characterized in that the ratio obtained by dividing the diffraction intensity of the main diffraction plane (4,1,1) of the intermetallic compound by the diffraction intensity of the c plane (0,0,2) of the Mg alloy phase in an XRD analysis of the surface of the sheet is 0.040 or more.

Although the reason why the magnesium alloy sheet of the present invention exhibits excellent corrosion resistance is not necessarily clear, it is considered that this is because the state of existence of the intermetallic compound containing the additive element (e.g., Al) and Mg (a typical example of which is $Mg_{17}Al_{12}$) is closely related to the excellent corrosion resistance. A major factor is believed to be that the ratio of the diffraction intensity of the main diffraction plane (4,1,1) of the intermetallic compound to the diffraction intensity of the c plane (0,0,2) of the Mg alloy phase in an XRD analysis of the surface of the sheet (diffraction intensity of the main diffraction plane (4,1,1) of intermetallic compound/diffraction intensity of the c plane (0,0,2) of the Mg alloy phase) is 0.040 or more. Note that, in the present invention, the magnesium alloy contains Mg in an amount of 50% by mass or more.

The magnesium alloy sheet according to the present invention will be described below.

<<Magnesium Alloy Sheet>>

[Composition]

Examples of the magnesium alloy constituting the magnesium alloy sheet include magnesium alloys containing an additive element and having various compositions (balance: Mg and impurities). In the present invention, it is preferable to use a Mg—Al-based alloy containing, as an additive element, 3.0% to 11.0% by mass of Al. As the Al content increases, corrosion resistance becomes higher and mechanical properties, such as strength and plastic deformation resistance, tend to become higher. Furthermore, by incorporating Al into the alloy, it is possible to precipitate particles of an intermetallic compound (βphase) containing Al and Mg, as precipitates, when a magnesium alloy sheet is produced. On the other hand, when the Al content is excessively high, there is a concern that plastic formability may be degraded. More preferably, the Al content is 8.3% to 9.5% by mass.

Examples of the additive element other than Al include at least one element selected from the group consisting of Zn, Mn, Si, Ca, Sr, Y, Cu, Ag, Zr, Ce, Be, and rare-earth elements (excluding Y and Ce). When these elements are incorporated into the alloy, the content thereof in total is preferably 0.01% to 10% by mass, and more preferably 0.1% to 5% by mass. Furthermore, the content of rare-earth elements is preferably 0.1% by mass or more, and among them, Y is preferably contained in an amount of 0.5% by mass or more. More specifically, examples of the Mg—Al-based alloy include AZ-based alloys (Mg—Al—Zn-based alloys, Zn: 0.2% to 1.5% by mass), AM-based alloys (Mg—Al—Mn-based alloys, Mn: 0.15% to 0.5% by mass), Mg—Al—RE (rare-earth element)-based alloys, AX-based alloys (Mg—Al—Ca-based alloys, Ca: 0.2% to 6.0% by mass), and AJ-based alloys (Mg—Al—Sr-based alloys, Sr: 0.2% to 7.0% by mass) specified in the standards of ASTM. In particular, Mg—Al—Zn-based alloys containing 8.3% to 9.5% by mass of Al and 0.5% to 1.5% by mass of Zn, typified by an AZ91 alloy, are preferable from the viewpoint of excellent corrosion resistance. Examples of the impurities include Fe, Ni, and Cu.

[Structure]

<Intermetallic Compound>

(Composition)

In the present invention, the sheet has a structure in which particles of an intermetallic compound are dispersed. In the case of a sheet composed of a magnesium alloy containing Al as an additive element, the intermetallic compound is typically $Mg_{17}Al_{12}$ containing Al and Mg.

(Ratio of Diffraction Intensity of Main Diffraction Plane (4,1,1) of Intermetallic Compound to the Diffraction Intensity of c Plane (0,0,2) of Mg Alloy Phase in XRD Analysis)

In the present invention, the ratio obtained by dividing the diffraction intensity of the main diffraction plane (4,1,1) of the intermetallic compound (such as $Mg_{17}Al_{12}$) by the diffraction intensity of the c plane (0,0,2) of the Mg alloy phase in an XRD analysis of the surface of the sheet is 0.040 or more. The higher the ratio, the more preferable it is. The ratio is more preferably 0.055 or more, and still more preferably 0.060 or more. Although the upper limit of the ratio is not particularly limited, 0.10 is believed to be an appropriate upper limit from the standpoint of practical production.

Specific examples of an apparatus used in the XRD analysis and analysis conditions will be described in detail later.

(Area Ratio)

In the present invention, the area ratio of the intermetallic compound ($Mg_{17}Al_{12}$ or the like) in SEM observation of a cross section of the sheet is preferably 10.0% or higher. The term "area ratio" refers to the percentage ratio (%) of the total area of the intermetallic compound to the area of an observed field of view in SEM observation of a cross section of the sheet. The higher the area ratio, the more preferable it is. The area ratio is more preferably 10.5% or higher, and still more preferably 10.6% or higher. Although the upper limit of the area ratio is not particularly limited, 15% is believed to be an appropriate upper limit from the standpoint of practical production.

(Particle Shape and Average Particle Size)

In the present invention, the particles of the intermetallic compound ($Mg_{17}Al_{12}$ or the like) preferably include particles with an aspect ratio of less than 2. The aspect ratio is defined by the ratio of the major axis to minor axis of a particle (major axis/minor axis). In particular, more preferably, the particles of the intermetallic compound include spherical particles with an aspect ratio of less than 2 and rod-like particles with an aspect ratio of 2 or more. The incorporation of the rod-like particles with an aspect ratio of 2 or more can further improve corrosion resistance. Still more preferably, the particles of the intermetallic compound include rod-like particles with an aspect ratio of 3 or more.

In the present invention, among the particles of the intermetallic compound ($Mg17Al_{12}$ or the like), spherical particles (with an aspect ratio of less than 2) preferably have an average particle size of 0.4 μm or more. The average particle size refers to a value obtained by determining the number of spherical particles of the intermetallic compound in an observed field of view in SEM observation of a cross section of the sheet, considering a value obtained by dividing the total area of the particles present in the observed field of view by the number of the particles as an area of a circular (spherical) particle, and calculating a diameter of a circle having an area equivalent to this area. The larger the average particle size, the more preferable it is. The average particle size is more preferably 0.5 μm or more. The upper limit of the average particle size is not particularly limited. If coarse particles of the intermetallic compound are present in an excessively large amount, fractures and the like are likely to occur during plastic forming Therefore, 5 μm is believed to be an appropriate upper limit.

[Corrosion Resistance]

In the present invention, the magnesium alloy sheet exhibits excellent corrosion resistance, and the corrosion weight loss in a salt spray test (testing method according to JIS Z 2371:2000) is small. For example, a corrosion weight loss, after 96 hours of the salt spray test, of 0.25 mg/cm$^2$ or less can be achieved. The smaller the corrosion weight loss, the more preferable it is. The corrosion weight loss is more preferably 0.20 mg/cm$^2$ or less. In the salt spray test, salt water with a concentration of 5% (1 liter of an aqueous solution in which 50 g of a salt is dissolved) is used.

[Production Method]

The magnesium alloy sheet of the present invention can be produced, for example, by a production method of the present invention described below. A method for producing a magnesium alloy sheet according to the present invention is characterized by including the following steps:

Casting step: A step of producing a cast material composed of a magnesium alloy containing an additive element by continuous casting.

Heat treatment step: A step of holding the cast material at 400 ° C. or higher and then cooling the cast material at a cooling rate of 30 ° C./min or less to produce a heat-treated material.

Rolling step: A step of subjecting the heat-treated material to warm rolling to produce a rolled sheet.

Furthermore, the method may include a straightening step of subjecting the rolled sheet to warm straightening.

It is difficult to directly subject the cast material to rolling, and the heat treatment step is performed in order to soften the cast material before rolling. Furthermore, in the heat treatment step, holding the cast material at a predetermined temperature for a certain period of time is effective for homogenizing the composition of the magnesium alloy and dissolving the additive element, such as Al, into the magnesium alloy. It has been considered that when a large amount of coarse particles of the intermetallic compound ($Mg17Al_{12}$ or the like) is precipitated in the cooling process in the heat treatment step, corrosion resistance would be decreased. Therefore, for example, after holding the cast material at 350° C. or higher, forced cooling has been performed by water cooling, air blasting, or the like. Specifically, in order to allow the cast material to quickly pass the temperature range (350° C. to 250° C.) in which the precipitation rate of the intermetallic compound is high, the cast material has been cooled (rapidly cooled) at a cooling rate of 100° C. /min or more in the temperature range of 350° C. to 250° C. to obtain a solid solution. However, according to thorough studies carried out by the present inventors, it has been found that by performing cooling (slow cooling) at a cooling rate of 30° C./min or less, instead of performing rapid cooling, in the heat treatment step, it is possible to finally obtain a rolled sheet (magnesium alloy sheet) exhibiting excellent corrosion resistance.

The individual steps will be described below.

<Casting Step>

In the casting step, a cast material having a predetermined composition is produced by a continuous casting process, such as a twin-roll process. For example, the continuous casting technique described in WO2006/003899 can be used. In the continuous casting process, since rapid solidification is possible, occurrence of oxides, segregation, and the like can be reduced, and generation of coarse precipitates (intermetallic compound) exceeding 10 μm can be suppressed. The thickness of the cast material is not particularly limited. If the thickness is excessively large, segregation is likely to occur. Therefore, the thickness is preferably 10 mm or less, and more preferably 5 mm or less.

<Heat Treatment Step>

In the heat treatment step, the cast material is held at 400° C. or higher and then cooled at a cooling rate of 30° C./min or less to produce a heat-treated material. In the heat treatment, heating is performed to 400° C. to 420° C., preferably 410° C. or lower, and this state is held for 60 to 2,400 minutes (1 to 40 hours). The holding time is preferably increased as the Al content is increased. The temperature range in which cooling is performed at a cooling rate of 30° C./min or less is, for example, a range of 400° C. to 250° C. More preferably, as described below, the temperature range is divided into two: a temperature range of 400° C. to 350° C. and a temperature range of 350° C. to 250° C., and the cooling rate is adjusted in each of the temperature ranges.

Preferably, cooling is performed at a cooling rate of 30° C./min or less from 400° C. to 350° C., and cooling is performed at a cooling rate of 10° C./min or less from 350° C. to 250° C. In particular, in the temperature range of 400° C. to 350° C., cooling is performed more preferably at a cooling rate of 2.0° C./min or less, and still more preferably at a cooling rate of 0.2° C./min or less. In the temperature range of 350° C. to 250° C., cooling is performed more preferably at a cooling rate of 1.0° C./min or less.

In such a manner, by performing the heat treatment step under conditions of slow cooling, it is possible to produce a rolled sheet (magnesium alloy sheet) having excellent corrosion resistance. Specifically, it is possible to produce a magnesium alloy sheet having a specific structure such as that described above. Furthermore, by adjusting the cooling rate for each of the temperature ranges, it is possible to control the precipitation state of the intermetallic compound ($Mg_{17}Al_{12}$ or the like) (specifically, the ratio of the diffraction intensity of the main diffraction plane (4,1,1) of the intermetallic compound to the diffraction intensity of the c plane (0,0,2) of the Mg alloy phase in the XRD analysis, the area ratio, the particle shape, and the average particle size as described above), and thus corrosion resistance can be improved.

<Rolling step>

In the rolling step, the heat-treated material is subjected to warm rolling to produce a rolled sheet. When the heat-treated material is subjected to rolling, by heating the workpiece (heat-treated material or sheet being subjected to rolling including final rolling), plastic formability (rolling workability) can be enhanced. In particular, when the workpiece is heated to higher than 300° C., plastic formability is sufficiently enhanced and the rolling process is easily performed. However, when the heating temperature of the workpiece is increased, burning may occur in the workpiece during the rolling process, crystal grains in the magnesium matrix may be coarsened, and a large amount of coarse particles of the intermetallic compound may be generated. As a result, there is a possibility that mechanical properties of the final rolled sheet will be degraded. Consequently, the heating temperature of the workpiece in the rolling step is set at 300° C. or lower. In particular, preferably, the heating temperature of the workpiece is 150° C. to 280° C. Furthermore, by performing rolling multiple times (multipass rolling), a desired thickness (e.g., 0.3 to 30 mm) can be achieved, and the average crystal grain size of the matrix can be decreased (e.g., 10 μm or less, preferably 5 μm or less) so that plastic formability in rolling, press forming, or the like can be enhanced. The rolling can be performed under known conditions. For example, not only the workpiece, but also a reduction roll may be heated, and the controlled rolling described in Patent Literature 1 may be used in combination therewith.

Furthermore, it is preferable to control the heat history of the workpiece such that, in the steps subsequent to the heat treatment step, including the rolling step, the total holding time for which the workpiece is held in a temperature range of 150° C. to 300° C. is set to 12 hours or less, and the workpiece is not heated to a temperature exceeding 300° C. By controlling the holding time for which the workpiece is held in a temperature range of 150° C. to 300° C., excessive growth (coarsening) of the particles of the intermetallic compound can be suppressed. Preferably, controlling is performed such that the temperature range is set to be 150° C. to 280° C., and the total holding time is set to be 6 hours or less.

In the case where multipass rolling is performed, intermediate heat treatment may be performed between passes on the condition that the holding time for which the workpiece is held in a temperature range of 150° C. to 300° C. is included in the total holding time. By performing the intermediate heat treatment, it is possible to remove or reduce the strain, residual stress, texture, and the like introduced into the workpiece by plastic forming (mainly rolling) until the intermediate heat treatment. In the rolling process subsequent to the intermediate heat treatment, inadvertent fractures, strain, and deformation are prevented, and smoother rolling can be performed. In the case where the intermediate heat treatment is performed, the heating temperature of the workpiece is also set at 300° C. or lower. In the intermediate heat treatment, the preferable heating temperature of the workpiece is 250° C. to 280° C.

<Straightening Step>

In the straightening step, straightening is performed with the rolled sheet being heated to 100° C. to 300° C. In this case, the holding time for which the workpiece is held in a temperature range of 150° C. to 300° C. is set so as to be included in the total holding time. The rolled sheet produced by the rolling step may be subjected to the final heat treatment (final annealing) described in Patent Literature 1. When the warm straightening is performed without performing the final heat treatment or after the final heat treatment is performed, plastic formability, such as press forming, can be enhanced. Straightening may be performed, using the roll leveler described in W02009/001516 or the like, by heating the rolled sheet to 100° C. to 300° C., preferably 150° C. to 280° C. When the rolled sheet that has undergone such a warm straightening process is subjected to plastic forming, such as press forming, dynamic recrystallization occurs during the plastic forming, and thus the plastic forming process can be easily performed.

<Final Heat Treatment>

In the case where the final heat treatment is performed, the strain introduced into the rolled sheet by the rolling process can be removed. In the final heat treatment, for example, the rolled sheet is heated to a temperature of 100° C. to 300° C., and this state is held for 5 to 60 minutes. In this case, the holding time for which the workpiece is held in a temperature range of 150° C. to 300° C. is set so as to be included in the total holding time. Although Patent Literature 1 states that the heating temperature is set at 300° C. to 340° C., in order to suppress growth of crystal grains in the matrix as much as possible, it is desirable to shorten the heating time (for example, to less than 30 minutes) when the heating temperature is increased.

Furthermore, by subjecting the rolled sheet (magnesium alloy sheet of the present invention) obtained by the production method described above to plastic forming, such as press forming, a magnesium alloy structural member can be obtained. When plastic forming is performed in a temperature range of 200° C. to 300° C., plastic formability of the magnesium alloy sheet can be enhanced, and thus the plastic forming process can be easily performed. The time for which the magnesium alloy sheet is held at 200° C. to 300° C. during the plastic forming is very short, for example, 60 seconds or less, in press forming. Therefore, it is believed that defects, such as coarsening of the intermetallic compound, do not substantially occur.

Furthermore, after the plastic forming, the magnesium alloy structural member may be subjected to finish heat treatment so that the strain and residual stress introduced into the magnesium alloy structural member by the plastic forming can be removed and mechanical properties can be improved. The finish heat treatment can be performed under the same conditions as those of the final heat treatment (heating temperature: 100° C. to 300° C., and heating time: 5 to 60 minutes). In this case, it is also desirable that the holding time for which the workpiece is held in a temperature range of 150° C. to 300° C. be included in the total holding time.

Furthermore, after the plastic forming, the magnesium alloy structural member may be subjected to coating for the purpose of protecting the magnesium alloy structural member and improving aesthetic impression (design), corrosion resistance, and the like.

Advantageous Effects of Invention

The magnesium alloy sheet according to the present invention has excellent corrosion resistance because it has a structure in which the ratio obtained by dividing the diffraction intensity of the main diffraction plane (4,1,1) of the intermetallic compound by the diffraction intensity of the c plane (0,0,2) of the Mg alloy phase in an XRD analysis of the surface of the sheet is 0.040 or more. Furthermore, in the method for producing a magnesium alloy sheet according to the present invention, by setting the cooling conditions in the heat treatment step such that slow cooling at a cooling rate of 30° C./min or less is performed, it is possible to produce a magnesium alloy sheet having excellent corrosion resistance.

DESCRIPTION OF EMBODIMENTS

Figure 1:
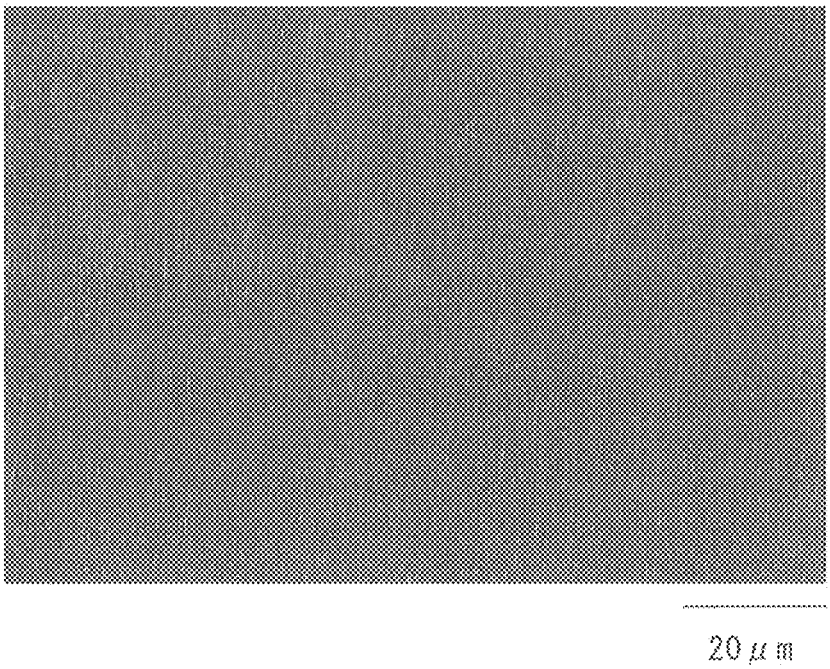
FIG. 1 shows an SEM photograph of a cross section of a magnesium alloy sheet of Sample No. 1.

Embodiments of the present invention will be described below.

EXPERIMENTAL EXAMPLE 1

Various magnesium alloy sheets having different structures were produced by varying the cooling conditions in the heat treatment step, and the structure and corrosion resistance of each sheet were evaluated.

In this experiment, magnesium alloy sheets of Sample Nos. 1 to 4 produced as described below were prepared.

A plurality of cast materials (thickness: 4 mm) composed of a magnesium alloy having a composition (9.0% Al-1.0% Zn-0.15% to 0.5% Mn (in terms of % by mass), balance being Mg) corresponding to an AZ91 alloy were produced by a twin-roll continuous casting process. In Sample Nos. 1, 3, and 4, long cast materials were produced and wound into coils. In Sample No. 2, a cast material was cut into a sheet having a predetermined length.

Next, each of the cast materials (coil or sheet) was placed in a heat-treating furnace and held at 400° C. for 24 hours, and then cooled under the conditions shown in Table Ito produce a heat-treated material. Note that the cooling rate in Table I is a value obtained by measuring the surface temperature of the coil or a value obtained by measuring the surface temperature of the sheet.

TABLE I

| Sample No. | Form | Temperature range of 400° C. to 350° C. Cooling rate (° C./min) | Temperature range of 350° C. to 250° C. Cooling rate (° C./min) |
|---|---|---|---|
| 1 | Coil | 300 | 270 |
| 2 | Sheet | 30 | 10 |
| 3 | Coil | 1.7 | 1.0 |
| 3 | Coil | 0.2 | 1.0 |

In Sample No. 1, the coil taken out of the heat-treating furnace was directly placed in a water tank, and was subjected to forced cooling by water cooling from 400° C. to 250° C. In Sample No. 2, the sheet taken out of the heat-treating furnace was placed in a temperature-controlled thermostatic chamber and was cooled by air cooling from 400° C. to 350° C. Then, the sheet was placed in another thermostatic chamber whose temperature was set at a lower temperature, and was cooled by air cooling from 350° C. to 250° C. In Sample No. 3, the coil taken out of the heat-treating furnace was left to stand and naturally cooled from 400° C. to 250° C. In Sample No. 4, the coil was left to stand in the heat-treating furnace in which heating was turned off and naturally cooled from 400° C. to 350° C. Then, the coil was taken out of the heat-treating furnace, left to stand, and naturally cooled from 350° C. to 250° C.

Next, each of the heat-treated materials was subjected to multipass rolling under the following conditions, and a rolled sheet (thickness: about 0.6 mm) was produced.

(Rolling Conditions)

Rolling reduction: 5%/pass to 40%/pass

Heating temperature of workpiece: 250° C. to 280° C.

Heating temperature of reduction roll: 100° C. to 250° C.

Furthermore, each of the rolled sheets was subjected to warm straightening while being heated at 200° C. The warm straightening was performed using a roll leveler including a heating furnace which heats a rolled sheet and a roll unit having a plurality of rolls which continuously apply bending (distortion) to the rolled sheet heated by the heating furnace. The roll unit includes a plurality of rolls arranged in a staggered manner so as to be vertically opposite each other. The roll leveler is configured such that the rolled sheet is transferred to the roll unit while being heated in the heating furnace, and bending is continuously applied to the rolled sheet by the rolls as the rolled sheet is passed between the upper and lower rolls of the roll unit.

Finally, the rolled sheet on which warm straightening had been performed was subjected to wet belt grinding using a #600 abrasive belt to smoothen the surface of the rolled sheet and to adjust the thickness of the rolled sheet to 0.6 mm. Furthermore, the heat history was controlled such that, in the steps subsequent to the heat treatment step, the total holding time for which the workpiece was held in a temperature range of 150° C. to 300° C. was set to 12 hours or less and the workpiece was not heated to a temperature exceeding 300° C.

Certain portions were cut out from the rolled sheets produced as described above to obtain magnesium alloy sheets of Sample Nos. 1 to 4.

<XRD Analysis of Surface of Sheet>

For each sample, the surface of the sheet was subjected to an X-ray diffraction (XRD) analysis, and the number of counts showing the diffraction intensity of the main diffraction plane (4,1,1) of the intermetallic compound and the number of counts showing the diffraction intensity of the c plane (0,0,2) of the Mg alloy phase in the XRD analysis of the surface of the sheet were measured. By dividing the former by the latter, the diffraction intensity ratio was obtained. The XRD analysis was performed using a Philips X'pert PRO multipurpose diffractometer. The XRD analysis conditions are as follows. The diffraction intensity ratio in each sample is shown in Table II.

(XRD Analysis Conditions)

X-ray used: Cu-Kα

Excitation conditions: 45 kV, 40 mA

Light-receiving optical system: Soller slit

Scanning method: θ-2θ scan

Measurement range: 2θ=20° to 50° (step width:)0.03°)

Count time: 1 sec

<SEM Observation of Cross Section of Sheet>

Figure 2:
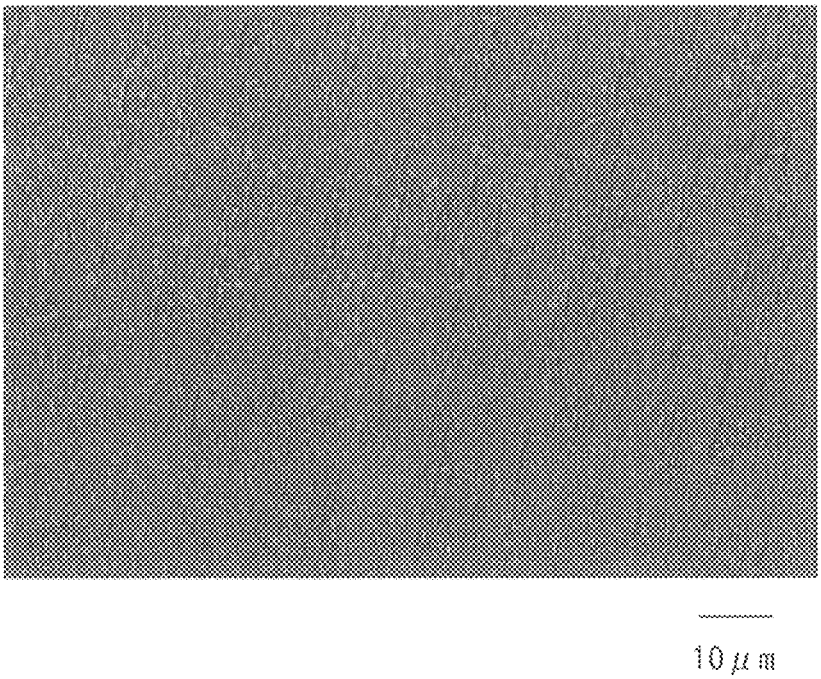
FIG. 2 shows an SEM photograph of a cross section of a magnesium alloy sheet of Sample No. 3.
Figure 3:
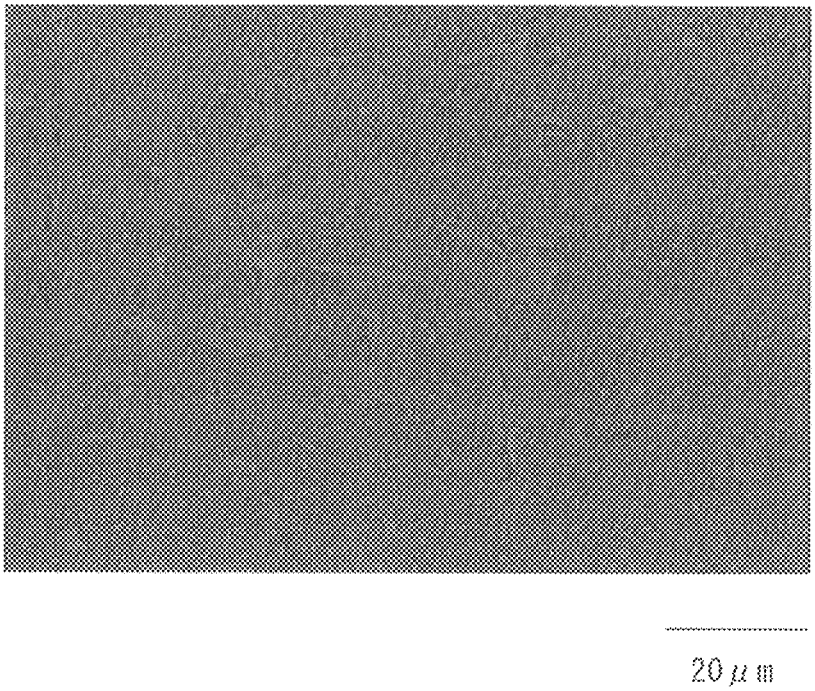
FIG. 3 shows an SEM photograph of a cross section of a magnesium alloy sheet of Sample No. 4.

For each of the samples, cross-sectioning was performed in the thickness direction along a direction orthogonal to the rolling direction with a cross section polisher using an Ar ion beam, and the resulting cross section was observed with a scanning electron microscope (SEM). In the SEM observation, a low accelerating voltage scanning electron microscope Ultra55 manufactured by Carl Zeiss AG was used. The SEM observation was performed under the conditions of an accelerating voltage of 5 kV without coating of the samples. The observation was performed using in-lens images. FIG. 1 shows an SEM photograph of Sample No. 1, FIG. 2 shows an SEM photograph of Sample No. 3, and FIG. 3 shows an SEM photograph of Sample No. 4. In FIGS. 1 to 3, light gray particles are the intermetallic compound ($Mg_{17}Al_{12}$). Furthermore, the streaks appearing in the longitudinal direction in the photographs are traces of the cross-sectioning process.

For each of the samples, the area ratio of the intermetallic compound ($Mg_{17}Al_{12}$) in SEM observation of a cross section of the sheet was determined In this example, a cross-sectioning process was performed five times, three fields of view were randomly observed in each of the five cross sections, the area of all particles of the intermetallic compound present in each observed field of view was checked, and the total area was calculated. In each of the total 15 observed fields of view, the ratio was obtained by dividing the total area of the intermetallic compound by the area of the observed field of view. The average value thereof was defined as the area ratio. The size of the observed field of view was 4 μm×6 μm (area: 24 $\mu m^2$). As the observed field of view, a region in which rod-like particles (with an aspect ratio of 2 or more) were not present, i.e., a region in which only spherical particles (with an aspect ratio of less than 2) were present, was selected. The area ratio (%) in each sample is shown in Table II.

Furthermore, in a similar manner, the average particle size of spherical particles (with an aspect ratio of less than 2) of the intermetallic compound ($Mg_{17}Al_{12}$) was determined by SEM observation of a cross section of the sheet. In this example, the number of all spherical particles present in each observed field of view was checked. In each of the total 15 observed fields of view, the area was calculated by dividing the total area of the intermetallic compound by the number of particles, a diameter of a circle having an area equivalent to this area was calculated. The average value thereof was defined as the average particle size. The average particle size (μm) in each sample is shown in Table II.

Furthermore, the particle shape of the intermetallic compound ($Mg_{17}Al_{12}$) was examined by SEM observation of a cross section of the sheet. In this example, in a given observed field of view (size of the observed field of view: 120 μm×90 μm), the shape of particles of the intermetallic compound present in the observed field of view was visually evaluated. The results show that, in Sample Nos. 1 and 2, only spherical particles with an aspect ratio of less than 2 were present. On the other hand, in Sample Nos. 3 and 4, spherical particles with an aspect ratio of less than 2 and rod-like particles with an aspect ratio of 2 or more were mixed. When the percentage of presence of rod-like particles with an aspect ratio of 2 or more was compared between Sample Nos. 3 and 4, in Sample No. 4, the number of rod-like particles with an aspect ratio of 2 or more was larger than that of Sample No. 3. Specifically, in Sample No. 3, three or more rod-like particles were present per observed field of view, while, in Sample No. 4, five or more rod-like particles were present per observed field of view. Furthermore, most of the rod-like particles observed in Sample Nos. 3 and 4 had an aspect ratio of 3 or more.

<Corrosion Resistance>

For each sample, a salt spray test was conducted and the corrosion weight loss was obtained. In this example, the test was conducted by the testing method according to JIS Z 2371:2000. In the salt spray test, a CASS test instrument CY-90 manufactured by Suga Test Instruments Co., Ltd. was used. The salt spray test was conducted under the conditions of a testing temperature of 35° C., a salt water concentration of 5%, and a testing time of 96 hours. The corrosion weight loss ($mg/cm^2$) in each sample is shown in Table II.

The corrosion weight loss was measured by the method described below. A test piece is obtained from each of Sample Nos. 1 to 4, and the mass (mass before testing) of each test piece is measured. Each of the test pieces is set in a test chamber of the salt spray test instrument, and the salt spray test is carried out for 96 hours. After the test is completed, each test piece is taken out from the test chamber, and the corrosion product is removed from the test piece. In order to remove the corrosion product, first, 1,000 ml of a solution is prepared by adding distilled water to 100 g of chromium (VI) oxide and 10 g of silver chromate, and the solution is boiled. By immersing each test piece in the solution in this state for one minute, the corrosion product is removed. Furthermore, 1,000 ml of a solution is prepared by adding distilled water to 200 g of chromium (VI) oxide, 10 g of silver chromate, and 20 g of barium sulfate, and the solution is heated to 20° C. to 25° C. By immersing each test piece therein for one minute, the corrosion product is removed. Subsequently, the deposit on the surface of each test piece is removed with a brush or the like, and then the test piece is washed with water and dried. After the corrosion product is removed from each test piece, the mass (mass after testing) of the test piece is measured. The value obtained by dividing the difference between the mass before testing and the mass after testing by the area of the test piece is defined as the corrosion weight loss. The mass measurement was performed using an electronic analytical balance AEU-210 manufactured by Shimadzu Corporation.

TABLE II

| Sample No. | Diffraction intensity ratio | Area ratio (%) | Average particle size of spherical particles (μm) | Particle shape | Corrosion weight loss ($mg/cm^2$) |
|---|---|---|---|---|---|
| 1 | 0.025 | 9.5 | 0.35 | Spherical | 0.411 |
| 2 | 0.040 | 10.0 | 0.40 | Spherical | 0.250 |
| 3 | 0.055 | 10.5 | 0.50 | Spherical + Rod-like | 0.199 |
| 4 | 0.060 | 10.6 | 0.50 | Spherical + Rod-like | 0.168 |

As is evident from the results of Table II, in Sample Nos. 2 to 4, in which the ratio of the diffraction intensity of the main diffraction plane (4,1,1) of the intermetallic compound ($Mg_{17}Al_{12}$) to the diffraction intensity of the c plane (0,0,2) of the Mg alloy phase in the XRD analysis is 0.040 or more, the corrosion weight loss after 96 hours of the salt spray test is 0.25 $mg/cm^2$ or less, and thus Sample Nos. 2 to 4 have superior corrosion resistance to that of Sample No. 1. Furthermore, from the standpoint of corrosion resistance, it is clear that, preferably, the area ratio of the intermetallic compound ($Mg17Al_{12}$) in the cross section of the sheet in SEM observation is 10% or higher, and the average particle size of particles of the intermetallic compound ($Mg_{17}Al_{12}$) is 0.4 μm or more. In particular, in Sample Nos. 3 and 4 which include rod-like particles of the intermetallic compound ($Mg_{17}Al_{12}$), the corrosion weight loss after 96 hours of the salt spray test is 0.20 $mg/cm^2$ or less, indicating more superior corrosion resistance.

The above-described results show that the magnesium alloy sheet produced under specific conditions exhibit excellent corrosion resistance. Specifically, Sample Nos. 2 to 4, in which cooling is performed under the slow cooling conditions of a cooling rate of 30° C./min or less in the heat treatment step, exhibit higher corrosion resistance than that of Sample No. 1 in which rapid cooling is performed as in the conventional art. Furthermore, it is clear that, preferably, cooling is performed at a cooling rate of 30° C./min or less in the temperature range of 400° C. to 350° C., and cooling is performed at a cooling rate of 10° C./min or less in the temperature range of 350° C. to 250° C. In particular, in Sample Nos. 3 and 4, in which cooling is performed at a cooling rate of 2.0° C./min or less in the temperature range of 400° C. to 350° C., and cooling is performed at a cooling rate of 1.0° C./min or less in the temperature range of 350° C. to 250° C., more superior corrosion resistance is exhibited.

It is to be understood that the present invention is not limited to the embodiments described above, but the embodiments can be appropriately modified within a range not departing from the gist of the present invention. For example, the composition of the magnesium alloy and the production conditions for the magnesium alloy sheet can be changed appropriately.

Industrial Applicability

The magnesium alloy sheet of the present invention can be suitably used for various structural members, such as electric/electronic devices, in particular, housings of mobile electric/electronic devices, such as cellular phones and laptop computers, and various other structural members requiring corrosion resistance. Furthermore, the method for producing a magnesium alloy sheet according to the present invention can be suitably used in producing a magnesium alloy sheet requiring corrosion resistance.

The invention claimed is:

1. A magnesium alloy sheet comprising:

a magnesium alloy containing 8.3% to 9.5% by mass of Al as an additive element, wherein:

the sheet has dispersed therein particles of an intermetallic compound containing the additive element and Mg, the ratio obtained by dividing the diffraction intensity of the main diffraction plane (4,1,1) of the intermetallic compound by the diffraction intensity of the c plane (0,0,2) of the Mg alloy phase in an XRD analysis of the surface of the sheet is 0.055 or more, particles of the intermetallic compound include spherical particles with an aspect ratio of less than 2, and rod-like particles with an aspect ratio of 2 or more.

2. The magnesium alloy sheet according to claim 1, wherein the ratio obtained by dividing the diffraction intensity of the main diffraction plane (4,1,1) of the intermetallic compound by the diffraction intensity of the c plane (0,0,2) of the Mg alloy phase is 0.060 or more.

3. The magnesium alloy sheet according to claim 1, wherein the corrosion weight loss after 96 hours of a salt spray test is 0.25 $mg/cm^2$ or less.

4. The magnesium alloy sheet according to claim 1, wherein the corrosion weight loss after 96 hours of a salt spray test is 0.20 $mg/cm^2$ or less.

5. The magnesium alloy sheet according to claim 1, wherein the area ratio of the intermetallic compound in SEM observation of a cross section of the sheet is 10.0% or higher.

6. The magnesium alloy sheet according to claim 1, wherein the area ratio of the intermetallic compound in SEM observation of a cross section of the sheet is 10.5% or higher.

7. The magnesium alloy sheet according to claim 1, wherein the area ratio of the intermetallic compound in SEM observation of a cross section of the sheet is 10.6% or higher.

8. The magnesium alloy sheet according to claim 1, wherein the spherical particles of the intermetallic compound has an average particle size of 0.4 μm or more.

9. The magnesium alloy sheet according to claim 1, wherein the spherical particles of the intermetallic compound has an average particle size of 0.5 μm or more.

10. A method for producing the magnesium alloy sheet according to claim 1, the method comprising:

a casting step of producing a cast material composed of a magnesium alloy containing an additive element by continuous casting;

a heat treatment step of holding the cast material at 400° C. or higher and then cooling the cast material at a first cooling rate of 30° C/min or less from a first temperature range of 400° C. to 350° C., and at a second cooling rate of 1.0° C/min or less from a second temperature range of 350° C. to 250° C., to produce a heat-treated material, wherein in the heat treatment step, the first cooling rate is different from the second cooling rate; and a rolling step of subjecting the heat-treated material to warm rolling to produce a rolled sheet.

11. The method for producing a magnesium alloy sheet according to claim 10, wherein the magnesium alloy contains, as the additive element, 8.3% to 9.5% by mass of Al.

12. The method for producing a magnesium alloy sheet according to claim 10, wherein cooling is performed at a cooling rate of 2.0° C/min or less from 400° C. to 350° C.

13. The method for producing a magnesium alloy sheet according to claim 10, wherein cooling is performed at a cooling rate of 0.2° C/min or less from 400° C. to 350° C.

* * * * *